United States Patent [19]

Sato

[11] 4,119,033

[45] Oct. 10, 1978

[54] INK ROLLER DEVICE FOR PRINTING HEAD OF HAND LABELER

[75] Inventor: Yo Sato, Tokyo, Japan

[73] Assignee: Kabushiki Kaisha Sato, Tokyo, Japan

[21] Appl. No.: 802,426

[22] Filed: Jun. 1, 1977

[30] Foreign Application Priority Data

Jun. 15, 1976 [JP] Japan ..... 51-077211[U]

[51] Int. Cl.[2] ..... B41J 1/42

[52] U.S. Cl. ..... 101/348; 24/213 CS; 101/288; 101/295; 101/314; 101/320; 101/324; 101/359; 206/356; 312/187; 312/45

[58] Field of Search ..... 312/45, 71, 185, 187; 24/213 CS, 214; 206/44, 12, 356, 391; 101/326, 327, 333, 316, 348–350, 287, 288, 295, 314, 320, 324, 359

[56] References Cited

U.S. PATENT DOCUMENTS

| | | | |
|---|---|---|---|
| 2,976,510 | 3/1961 | Blain | 312/187 |
| 2,976,986 | 3/1961 | Linn | 206/356 |
| 3,326,124 | 6/1967 | Heil et al. | 101/348 |
| 3,388,662 | 6/1965 | Ravreby | 101/333 |
| 3,551,963 | 1/1971 | Mosher, Jr. et al. | 24/213 CS |
| 3,759,178 | 9/1973 | Franchinot et al. | 101/349 |
| 3,785,288 | 1/1974 | Hunter | 101/348 |
| 3,854,201 | 12/1974 | Dawidowkz et al. | 206/356 |
| 3,918,214 | 11/1975 | Buschman | 24/213 CS |
| 3,968,745 | 7/1976 | Hamisch, Jr. | 101/288 |

*Primary Examiner*—William Pieprz

*Attorney, Agent, or Firm*—Ostrolenk, Faber, Gerb & Soffen

[57] ABSTRACT

An ink roller device for use with a printing head of a hand labeler, or the like: an ink roller holder including a mounting assembly having a clip adapted to be removably mounted to the hand labeler; a pair of arms extend from the mounting assembly; each of the arms has a round notch at its free end; this notch has an entrance cut which is made narrower than the inside diameter of the notch; spring means bias the arms so that their free ends may be brought close to the type characters of the printing head; an ink roller assembly is removably supported on the ink roller holder; the ink roller assembly includes an ink roller body and a pair of split shafts which project from both ends of the roller body; each split shaft comprises a plurality of axially split elements which are made of a flexible material and which are sized and positioned so that they may be snap fitted snugly into the round notches of the arms through their cuts.

12 Claims, 7 Drawing Figures

INK ROLLER DEVICE FOR PRINTING HEAD OF HAND LABELER

BACKGROUND OF THE INVENTION

1. Field of the Invention

The present invention relates to an ink roller device for use with a printing head of a label printing and applying machine or a printing and tagging machine, both preferably of the portable type.

2. Description of the Prior Art

In portable label printing and applying machines (hereafter referred to as a "hand labeler") and in printing and tagging machines, a spongy ink impregnated roller is rolled over the type characters of printing wheels or printing bands to supply them with ink prior to imprinting labels or tags. When the ink supply in the ink roller is consumed, there are a number of techniques of ink resupply.

In one method, the syringe-shaped injecting mouth of an ink bottle is pushed against the outer periphery of an ink roller, and the ink roller is progressively supplied and impregnated with the ink as its periphery turns past the ink bottle. Since the ink penetrates into the spongy roller from its outer periphery, this method of ink resupply consumes much time with resulant inefficiency. Moreover, it is difficult to effect uniform ink impregnation of the deep and outer peripheral portions of an ink roller having considerable thickness. This may cause irregular ink application to the type characers, leading to irregular and unclear imprinting of the labels and tags. Moreover, excessive ink will drop to stain the inside of the machine or the printed labels and tags. Further, the fingers or clothing of the operator as well as a commodity being labeled or tagged are often stained with ink. As a result, ink resupply has been disliked by the labeler operators.

A second method of ink resupply is comprised of replacing a used ink roller with a new ink impregnated roller. Usually, the ink roller itself is pinched directly by the fingers of the operator, and its shaft is pulled in the axial or transverse direction for the subsequent replacement. As a result, the fingers and clothes of the operator are stained, and the assembly and disassembly of the ink roller holder, the ink roller and the ink roller shaft invite trouble and have disadvantages.

In a third method of ink resupply, the ink roller and its holder are assembled into a unitary structure which is replaced as a whole by a new assembly. This involves so high a cost that it has never been placed into practical use.

SUMMARY OF THE INVENTION

It is a major object of the present invention to provide an ink roller device for use with a printing head of a hand labeler or the like, which is free of the drawbacks of the prior art.

Another object of the present invention is to provide an ink roller device of the above type, in which an ink roller may be removably fitted in an ink roller holder by a single action and which also does not require any manual handling of the inking roller.

Still another object of the invention is to provide an ink roller device of the above type, in which replacement of the ink roller can be accomplished promptly without any damage being caused by the ink.

A further object of the invention is to provide an ink roller device of the above type, in which clear printing of the labels or tags can be obtained at all times.

An ink roller device according to the present invention comprises an ink roller holder including: a mounting assembly having a clip adapted to be removably mounted in position relative to the printing head; a pair of arms extending from the mounting assembly; each arm including a round notch formed at its free end; each notch having an entrance cut which is narrower than the inside diameter of the respective round notch; means for biasing the arms so that their free ends may come close to the type characters of said printing head; an ink roller assembly removably supported on the ink roller holder and including a roller body impregnated with ink; a pair of split shafts project from both ends of the roller body; the shafts having a plurality of axially split shaft elements made of a flexible, resilient material; and the shaft elements being sized and positioned so that they may be snap fitted snugly in the round notches of the arms in passing through the cuts thereof.

BRIEF DESCRIPTION OF THE DRAWINGS

Other objects and features of the present invention will become apparent from the following description taken in conjunction with the accompanying drawings, in which.

DESCRIPTION OF A PREFERRED EMBODIMENT

Figure 3:
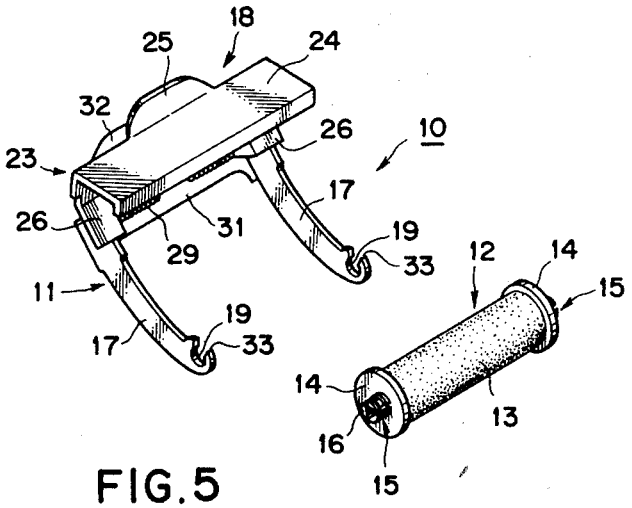
FIG. 3 is a perspective view showing an ink roller and the holder of the ink roller device separated.
Figure 4:
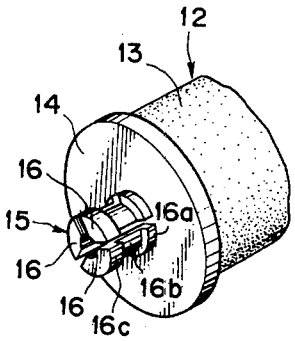
FIG. 4 is a perspective view showing a major portion of the ink roller.

Referring to FIGS. 3 and 4, an ink roller device 10 according to the present invention, is comprised of an ink roller holder 11 and an ink roller assembly 12. The ink roller assembly 12 includes a spongy roller body 13 impregnated with ink, a respective one of a pair of flanges 14 fixed to each end of the roller body 13 and a pair of shafts 15 formed on the flanges 14 and projecting therefrom coaxially with each other and with roller 13.

As shown on an enlarged scale in FIG. 4, each of the shafts 15 is comprised of three annularly separated shaft elements 16, which are made of a flexible and resilient material, such as a plastic, and which extend axially and are uniformly arrayed around the axis of shaft 15. Each of the shaft elements 16 includes three axially juxtaposed portions, a radially expanded base portion **16*a*, a reduced radius center portion 16*b* and a radially expanded outer flange portion 16*c*. Although each of the shafts 15 is described as being split into three elements 16, the present invention contemplates use of shafts that are split into any desired plurality of elements. The outer width or diameter of the entire shaft 15 is related to the size of the below described notches 19**.

The ink roller holder 11 includes a pair of arms 17 which extend parallel to each other from a mounting assembly 18 of the clip type. Each of the arms 17 has a round notch 19 near its free or leading end at its free end portion. The arms have a free end edge and have top and bottom side edges leading to the free end edge. The notches are formed in a side edge of both arms at the free end portions of the arms.

Figure 1:
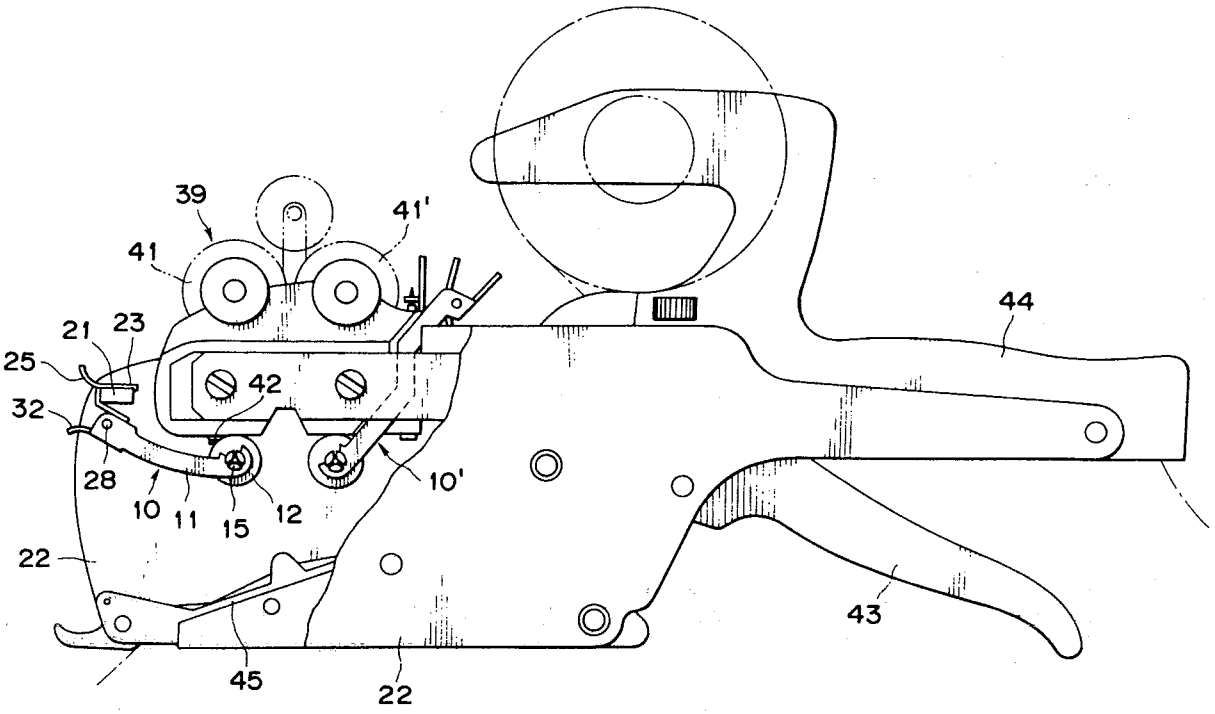
FIG. 1 is a partially broken away, side elevational view of a hand labeler which is equipped with an ink roller device according to the present invention, with the hand lever of the labeler released.
Figure 2:
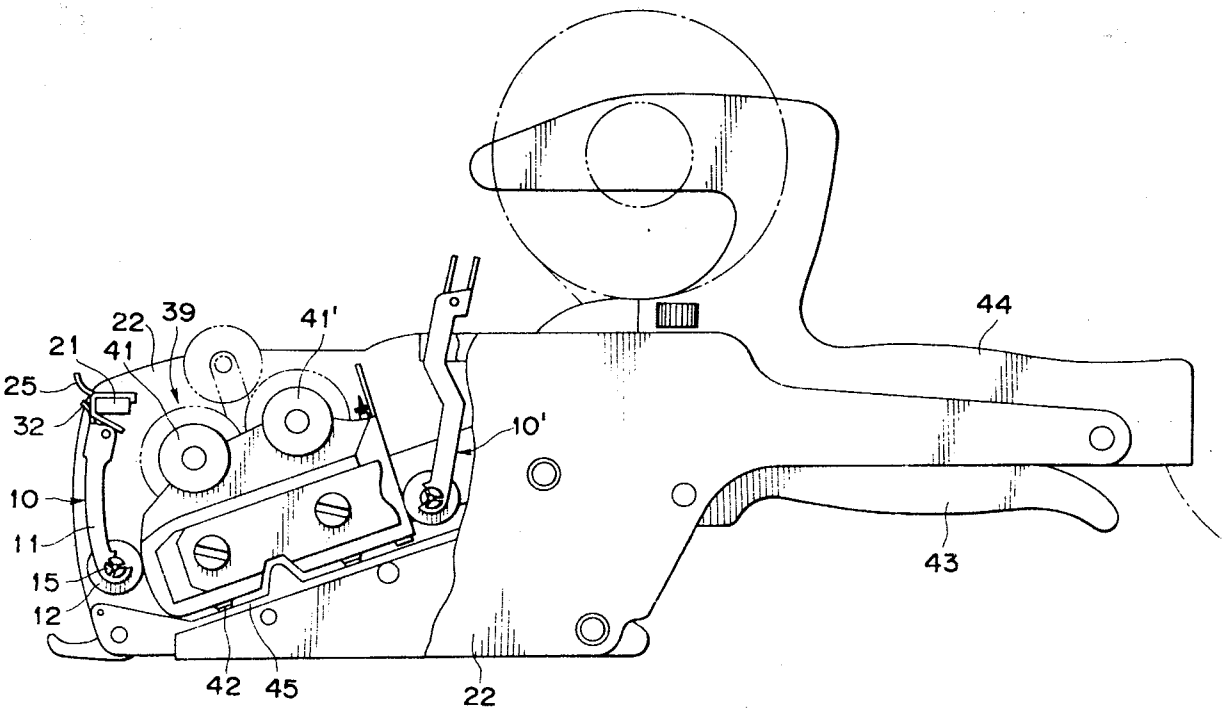
FIG. 2 is a view similar to FIG. 1, but showing the condition of the hand labeler in which the hand lever is gripped.

Turning to FIGS. 1 and 2, the mounting assembly 18 is removably mounted to a stay or rigid support 21 which is supported between the pair of side plates 22 of the hand labeler. As better shown in FIG. 6, a clip 23 is mounted in the mounting assembly 18 of the ink roller device in a swinging, elastic manner. More specifically, the clip 23 is comprised of an L-shaped side plate 24, an ear 25 curving upwardly from one end of the side plate 24, and a pair of receiving plates 26 extending substantially in the shape of the letter "L" downwardly from the end portions of the side plate 24.

Figure 6:
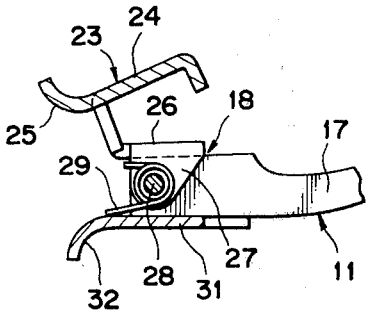
FIG. 6 is a cross-sectional view showing the mounting assembly of the ink roller holder.

There are a pair of walls 27 which are integral with the receiving plates 26 and depend beneath them. The depending walls 27 and the arms 17 are formed with a common pin hole, through which a pin 28 is inserted to mount thereon a torsion spring 29 so that the clip 3 may be biased clockwise and the arms 17 may be biased counterclockwise, as seen in FIG. 6. The arms 17 are formed with a connecting plate 31 at their ends. The plate includes a downwardly curving ear 32.

Referring to FIG. 3, each of the round notches 19 includes an entrance cut 33 which is narrower than the inside width or diameter of the notches 19. The inside width or diameter of notches 19 is slightly larger than the outside width or diameter of the reduced diameter center portions **16*b* of the split shafts 15. To fit the split shafts 15 into the round notches 19, the reduced center portions 16*b* of the shafts 15 are forced through the narrowed width cuts 33 into the round notches 19. The walls of the narrowed cuts 33 squeeze the center portions 10*b* inwardly, as the shaft elements 16 are flexible. Once they are in the notches 19, the shaft elements 16 resiliently restore their original shapes until the overall diameter of the reduced center portions 16*b* become larger than the width of the cuts 33 of the notches 19. As a result, the split shafts 15 are fitted snugly in the round notches 19 of the arms 17**.

Figure 7:
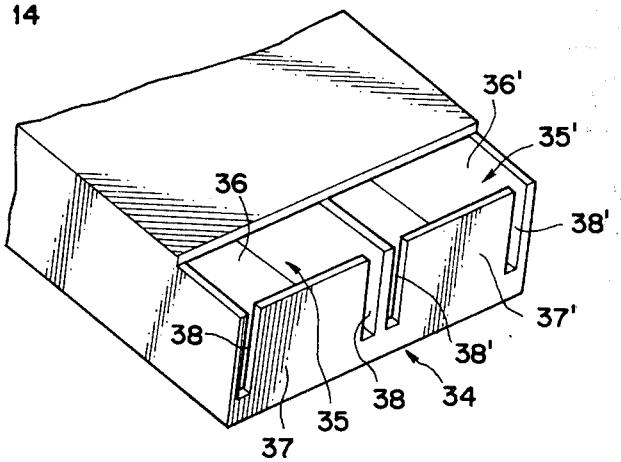
FIG. 7 is a perspective view showing a portion of a casing for containing ink rollers.

Referring to FIG. 7, there is a casing 34 which accommodates a number of ink roller assembles 12. In the casing 34, there are arranged one or more rows of chambers 35, 35' in which the ink roller assemblies 12 are arranged in parallel. Each of the chambers 35 and 35' has one end that includes an outlet 36 and 36', through which the ink roller assemblies 12 are removed, one by one. Front walls 37 and 37' are formed in the vicinity of the outlets 36 and 36' and each of the walls is formed with a pair of spaced apart, upright slots 38 or 38'. The slots 38 or 38' are located to be at the reduced center portions **16*b* of the opposite split shafts 15. The width of each slot 38 or 38' is slightly larger than the thickness of the arms 17 of the ink roller holder 11, and the spacing between the slots 38 or 38' of one of the chambers 35 and 35' is made equal to the distance between the arms 17**.

The operation of the above described ink roller device is now described. To mount an ink roller assembly 12 to the ink roller holder 11, the ink roller assembly 12 can be held by an operator who attaches it to the holder 11. However, it is preferable to instead use the casing 34, partly because the operator can be free from having his fingers and clothes stained with ink and partly because he can accomplish the attachment within a short time period. A number of ink roller assemblies 12 have been previously positioned in the chambers 35 of the casing 34. The ink roller holder 11 is forced against the ink roller assembly 12, which is then located at the outlet 36 or 36', in a manner to push the cuts 33 of the round notches 19 of the holder 11 against the reduced center portions **16*b* of the split shafts 15 of the roller assembly 12. As a result, the shaft elements 15 flex and snap fit snugly into the notches 19 past the cuts 33 so that the ink roller assembly 12 can be held rotatably in the holder 11**.

Figure 5:
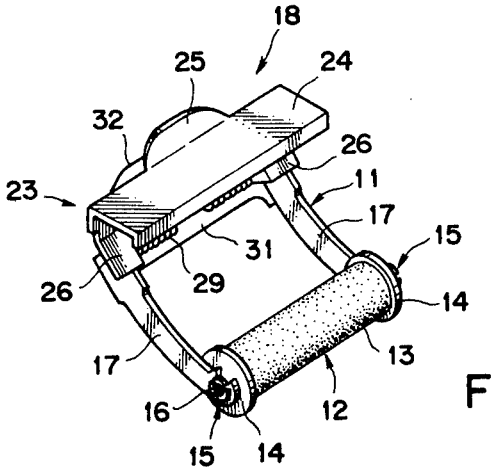
FIG. 5 is a perspective view showing the condition in which the ink roller is fitted in its holder.

Then, the upper and lower ears 25 and 32 of the ink roller holder 11 having the roller assembly 12 are clamped by the fingers of the operator, as shown in FIG. 5. The clip 23 is made to bite the stay 21 of the hand labeler, thus finishing the mounting of the ink roller device 10 to the hand labeler.

The hand labeler shown in FIG. 1 includes a printing head 39 which is equipped with a pair of front and rear printing devices 41 and 41'. The printing devices 41 and 41' are equipped with ink roller devices 10 and 10', respectively. The description herein is limited to the front ink roller device 10, because the two devices 10 and 10' are constructed to accomplish substantially the same functions.

In the ink roller device 10 at the front side of the labeler, the spring 29 biases the ink roller holder 11 in the counterclockwise direction, as seen in FIG. 1, so that the ink roller assembly 12 may be pressed against the type characters 42 of the printing device 41. When the hand lever 43 is gripped toward a hand grip 44 to move the printing head 39 downward, the ink roller device 10 is rotationally thrust aside until it is brought into the position shown in FIG. 2. Meanwhile, the type characters 42 imprint on a label or tag which is placed on a platen 45.

After the imprinting, the hand lever 43 is released to allow upward return movement of the printing head 39. Upon this ascent, the ink roller device 10 is returned by the action of the spring 29 to its original position of FIG. 1.

When the ink in the roller body 13 has been used up, the ears 25 and 32 are pinched to release the clip 23 from the stay 21, and the ink roller device 10 as a whole is removed from the hand labeler. Then, the ink roller holder 11 is placed on a surface, like a desk, with the cuts 33 directed upward with respect to or away from the surface. The ink roller holder 11 is depressed downward while pushing the outer circumferences of the flanges 14 of the ink roller assembly 12 onto the surface of the desk. As a result of this depression, the cuts 33 of the notches 19 push the outer peripheries of the split shafts 15, and the split shaft elements 16 are accordingly flexed inwardly so that the shafts 15 are released from the notches 19 to allow removal of the ink roller assembly 12 from the ink roller holder 11.

The ink roller assembly of the ink roller device according to the present invention can be replaced by a new assembly only by a single action without requiring direct handling of the assembly with the fingers of an operator. Not only the fingers and clothes of the operator but also commodities being labeled or tagged can be free from being stained with ink, and the labeling or tagging actions can be promoted efficiently, and the characters printed on the labels or the like can always be clear.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. In combination, an ink roller device for use in inking a printing head and an ink roller containing and supplying casing;

said ink roller device comprising:

a mounting assembly for mounting said ink roller device;

a pair of arms extending from said mounting assembly; each said arm having an end portion away from said mounting assembly; a notch defined in each said arm end portion; said notch including an entrance side leading into said notch;

an ink roller assembly removably attached to said arms; said ink roller assembly including an ink roller body; a pair of shafts, with each said shaft projecting from a respective end of said roller body; said shafts being so positioned and so sized as to be fittable in a respective one of said notches through said entrance sides thereof;

said casing having an upstanding front wall with two upstanding, vertically extending slots therein spaced a distance apart equivalent to the spacing distance separating said arms of said pair thereof; said casing having, on a wall perpendicular to the said front wall, an outlet opening through which an ink roller body may be extracted; said front wall slots extending along said front wall beginning at said outlet opening, whereby said arms of said ink roller device may be inserted into said casing through said front wall slots, with said notches of said arms extended into said casing such that said notches may engage said shafts of an ink roller body in said casing, and the engaged said ink roller body may then be removed through said casing outlet by raising of said arms out of said front wall slots of said casing;

a plurality of said ink roller bodies normally positioned in said casing at a location to be accessible to said casing outlet and said front wall slots thereof.

2. The combination of claim 1, wherein each said arm of said pair thereof has a notch defined in its respective said arm end portion; said notch including an entrance side leading into said notch and including a narrowed width cut at said entrance side of said notch which said cut is narrower than the major portion of said notch;

each said shaft of said ink roller body comprising a plurality of shaft elements, axially extending and separated from each other, and each comprised of a flexible and resilient material; said shaft elements being together so positioned and so sized as to be fittable in a respective one of said notches after being passed through said cut thereof.

3. The ink roller device of claim 2, wherein said shafts have an axial length, including an axially generally central portion; said central portions of said shafts being reduced in width; said central portions being the portions of said shafts that are received in said notches.

4. The ink roller device of claim 2, wherein said shaft elements are so shaped that said shafts have an external width that is larger than the widths of said cuts, thereby to retain said shafts in said notches.

5. The ink roller device of claim 2, wherein each said notch is round in shape and the said shaft elements of each said shaft together define a rounded shape around the exteriors thereof.

6. The ink roller device of claim 5, wherein said shafts have an axial length, including an axially generally central portion; said central portions of said shafts being reduced radially, said central portions being the portions of said shafts that are received in said notches.

7. The ink roller device of claim 5, wherein said shaft elements are so shaped that said shafts have an external diameter that is larger than the diameters of said cuts, thereby to retain said shafts in said notches.

8. The ink roller device of claim 7, wherein said shafts have an axial length, including an axially generally central portion, said central portions of said shafts being reduced radially; said central portions being the portions of said shafts that are received in said notches.

9. An ink roller device for use in inking a printing head, comprising;

a mounting assembly for mounting said ink roller device;

a pair of arms extending from said mounting assembly; each said arm having an end portion away from said mounting assembly;

an ink roller assembly removably attached to said arms; said ink roller assembly including an inking roller body; a pair of shafts, with each said shaft projecting from a respective end of said roller body; each said shaft being attached to a respective said arm for being supported thereby;

said mounting assembly comprising clip means for removably clipping said ink roller device to a fixed support that is so located with respect to a printing head that the printing head is placed to be engaged by said inking roller; said clip means comprising:

a side plate with a part thereon for engaging and holding the fixed support;

at a pivot located at a section of said arms remote from said ink roller, said arms being pivotally connected to said side plate for said arms to be pivotable with respect to said side plate;

engageable means on said arms and on said side plate, and when said engageable means on said arms and on said side plate are pinched together, in a direction transverse to the axis of the ink roller said arms and said inking roller pivot away from said side plate, from the fixed support and from the printing head;

biasing means for normally urging said inking roller and said arms to pivot toward said side plate, toward the fixed support and toward the printing head.

10. The ink roller device of claim 9, wherein said inking roller body is normally impregnated with ink.

11. The ink roller device of claim 9, wherein said engageable means are at one side of said pivot and said inking roller is at the opposite side of said pivot.

12. In combination, the ink roller device of claim 11, and a printing head and a fixed support located near to said printing head;

said side plate of said clip means being removably clippable to said fixed support for holding said inking roller at said printing head; said engageable means being so placed that pinching together of said engageable means on said side plate and said engageable means on said arms moves said inking roller away from said printing head.

* * * * *